US009672965B2

(12) United States Patent
Tera et al.

(10) Patent No.: US 9,672,965 B2
(45) Date of Patent: Jun. 6, 2017

(54) REACTOR

(71) Applicants: DENSO CORPORATION, Kariya, Aichi-pref. (JP); TOKYO METROPOLITAN UNIVERSITY, Tokyo (JP)

(72) Inventors: Takahiro Tera, Obu (JP); Hiroshi Taki, Okazaki (JP); Toshihisa Shimizu, Tokyo (JP)

(73) Assignees: DENSO CORPORATION, Kariya (JP); TOKYO METROPOLITAN UNIVERSITY, Tokyo (JP)

( * ) Notice: Subject to any disclaimer, the term of this patent is extended or adjusted under 35 U.S.C. 154(b) by 0 days.

(21) Appl. No.: 14/712,198

(22) Filed: May 14, 2015

(65) Prior Publication Data

US 2015/0332825 A1 Nov. 19, 2015

(30) Foreign Application Priority Data

May 14, 2014 (JP) ..... 2014-100747

(51) Int. Cl.
*H01F 17/06* (2006.01)
*H01F 27/24* (2006.01)
(Continued)

(52) U.S. Cl.
CPC ..... *H01F 3/04* (2013.01); *H01F 3/14* (2013.01); *H01F 27/25* (2013.01)

(58) Field of Classification Search
CPC ..... H01F 3/04; H01F 3/14; H01F 3/02; H01F 17/062; H01F 17/06; H01F 27/2455; H01F 27/25
(Continued)

(56) References Cited

U.S. PATENT DOCUMENTS 3,787,790 A * 1/1974 Hull ..... H01J 49/20 250/298
5,210,514 A * 5/1993 Ito ..... H01F 27/346 336/178
(Continued)

FOREIGN PATENT DOCUMENTS

JP 02-290005 11/1990
JP 2007-012647 1/2007
(Continued)

*Primary Examiner* — Mangtin Lian
(74) *Attorney, Agent, or Firm* — Nixon & Vanderhye P.C.

(57) ABSTRACT

A reactor includes a laminated core formed by laminating soft-magnetic ribbons in a lamination direction. The laminated core has a gap formed across a magnetic path direction in the laminated core. The laminated core also has a flat facing surface that faces the gap and a pair of flat side surfaces that are respectively on opposite sides of the facing surface in the lamination direction. The laminated core further has a pair of first corner curved surfaces that are formed between the facing surface and the pair of side surfaces. Each of the first corner curved surfaces has a width in the lamination direction greater than the thickness of each of the soft-magnetic ribbons. For each of the first corner curved surfaces, a length of the first corner curved surface in the magnetic path direction is greater than the width of the first corner curved surface in the lamination direction.

3 Claims, 12 Drawing Sheets

(51) Int. Cl.
*H01F 3/04* (2006.01)
*H01F 3/14* (2006.01)
*H01F 27/25* (2006.01)

(58) Field of Classification Search
USPC ..... 336/178, 234, 212, 213
See application file for complete search history.

(56) References Cited

U.S. PATENT DOCUMENTS

| | | | | |
|---|---|---|---|---|
| 5,315,279 | A * | 5/1994 | Ito | H01F 3/14 336/178 |
| 6,211,765 | B1 | 4/2001 | Ito et al. | |
| 6,232,865 | B1 * | 5/2001 | Zinders | H01F 27/263 336/212 |
| 2011/0199174 | A1 * | 8/2011 | Carsten | H01F 3/14 336/178 |

FOREIGN PATENT DOCUMENTS

| | | | |
|---|---|---|---|
| JP | 2012-023079 | | 2/2012 |
| JP | 2012-023079 | A * | 2/2012 |

* cited by examiner

REACTOR

CROSS-REFERENCE TO RELATED APPLICATION

This application is based on and claims priority from Japanese Patent Application No. 2014-100747, filed on May 14, 2014, the content of which is hereby incorporated by reference in its entirety into this application.

BACKGROUND

1 Technical Field

The present invention relates to reactors that employ a laminated core as a magnetic core.

2 Description of Related Art

As a magnetic core of a reactor, a laminated core may be employed which is formed by laminating a plurality of soft-magnetic ribbons made of a magnetic sheet steel, an amorphous alloy or a nanocrystalline alloy. Employing the laminated core, it is easy to increase the saturation magnetic flux density of the magnetic core. However, at the same time, the permeability of the magnetic core is prone to become high. Therefore, in the case of employing the laminated core, gaps are generally formed in the laminated core across the magnetic path of the laminated core.

However, with the gaps formed in the laminated core, fringing flux is generated outside the gaps in the lamination direction. Consequently, eddy current is generated on side surfaces of the laminated core in the vicinities of the gaps, i.e., generated in the soft-magnetic ribbons located at ends of the laminated core in the lamination direction, thereby increasing the eddy current loss. Moreover, due to generation of the fringing flux, it becomes easy for magnetic flux to concentrate on the soft-magnetic ribbons located at the ends of the laminated core, thereby increasing the hysteresis loss.

To solve the above problem, Japanese Patent Application Publication No. JP2007012647A discloses a complex magnetic core that is comprised of a laminated core and a plurality of dust cores. Each of the dust cores is formed by compacting ferromagnetic powder whose surface is insulation-treated. Moreover, gaps are formed between the dust cores. Consequently, with the dust cores that have a high electrical resistance, it is possible to suppress the generation of eddy current, thereby reducing the iron loss.

However, in the complex magnetic core disclosed in the above patent document, the dust cores have a relatively low permeability. Consequently, the magnetic reluctance of the entire complex magnetic core is increased, thereby increasing the loss of the complex magnetic core.

SUMMARY

According to exemplary embodiments, a reactor is provided which includes a laminated core and a coil wound around the laminated core. The laminated core is formed of a plurality of soft-magnetic ribbons that are laminated in a lamination direction. The laminated core has a gap that is formed in the laminated core across a magnetic path direction along which magnetic flux flows in the laminated core. The laminated core also has a flat facing surface that faces the gap and a pair of flat side surfaces that are respectively on opposite sides of the facing surface in the lamination direction. The laminated core further has a pair of first corner curved surfaces that are respectively formed between the facing surface and one of the side surfaces and between the facing surface and the other side surface. Each of the first corner curved surfaces has a width in the lamination direction greater than the thickness of each of the soft-magnetic ribbons forming the laminated core. For each of the first corner curved surfaces, a length of the first corner curved surface in the magnetic path direction is greater than the width of the first corner curved surface in the lamination direction.

With the above configuration, since the reactor employs the laminated core as its magnetic core, it is possible to lower the magnetic reluctance of the magnetic core, thereby reducing the loss of the magnetic core. Consequently, it is possible to easily realize a desired inductance of the magnetic core.

Moreover, since each of the first corner curved surfaces has its width in the lamination direction greater than the thickness of each of the soft-magnetic ribbons, it is possible to prevent the start or end points of fringing flux from concentrating on those peripheral soft-magnetic ribbons which constitute the side surfaces of the laminated core. Consequently, it is possible to reduce eddy current generated on the side surfaces of the laminated core, thereby reducing the eddy current loss. In addition, it is also possible to prevent magnetic flux from concentrating on particular soft-magnetic ribbons in the laminated core, thereby reducing the hysteresis loss and the eddy current loss.

Furthermore, since the first corner curved surfaces are not planar taper surfaces, it is possible to more effectively prevent magnetic flux from concentrating on particular soft-magnetic ribbons in the laminated core.

Moreover, since each of the first corner curved surfaces has its length in the magnetic path direction greater than its width in the lamination direction, it is possible to enhance the effect of reducing the eddy current loss. More specifically, it is possible to increase the distances from those peripheral soft-magnetic ribbons which constitute the side surfaces of the laminated core to the facing surface of the laminated core, thereby enhancing the effect of reducing the eddy current loss.

In a further implementation, the laminated core also has a pair of flat end surfaces that are respectively on opposite sides of the facing surface in a height direction of the laminated core. The height direction is perpendicular to both the lamination direction and the magnetic path direction. The laminated core further has a pair of second corner curved surfaces that are respectively formed between the facing surface and one of the end surfaces and between the facing surface and the other end surface. For each of the second corner curved surfaces, a length of the second corner curved surface in the magnetic path direction is greater than a width of the second corner curved surface in the height direction.

The laminated core may have a substantially annular shape such that the lamination direction coincides with an inside-outside direction of the laminated core. In this case, the first corner curved surfaces include an inner first corner curved surface that is on the inner side of the facing surface and an outer first corner curved surface that is on the outer side of the facing surface. It is preferable that the inner first corner curved surface has a different shape from the outer first corner curved surface. It is further preferable that the length of the inner first corner curved surface in the magnetic path direction is greater than the length of the outer first corner curved surface in the magnetic path direction.

For each of the first corner curved surfaces, those soft-magnetic ribbons which together constitute the first corner curved surface may be laminated so that distal ends of those soft-magnetic ribbons are offset from one another in the magnetic path direction.

When viewed along the height direction perpendicular to both the lamination direction and the magnetic path direction, each of the first corner curved surfaces may have a shape that is determined by the following Equation (1) on an x-y coordinate plane:

$$y = gab^{\frac{x+W-h}{g}} + g(1-a) \quad (1)$$

where the x-y coordinate plane has its x-axis set to a line that extends in the lamination direction through a center of the gap and its y-axis set to a line that extends in the magnetic path direction and is equidistant from the side surfaces of the laminated core, g is half of the size of the gap, h is half of the distance between the side surfaces of the laminated core, W is the width of the first corner curved surface in the lamination direction, a is a positive constant, b is a positive constant greater than 1, and $(h-W) \leq x \leq h$.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
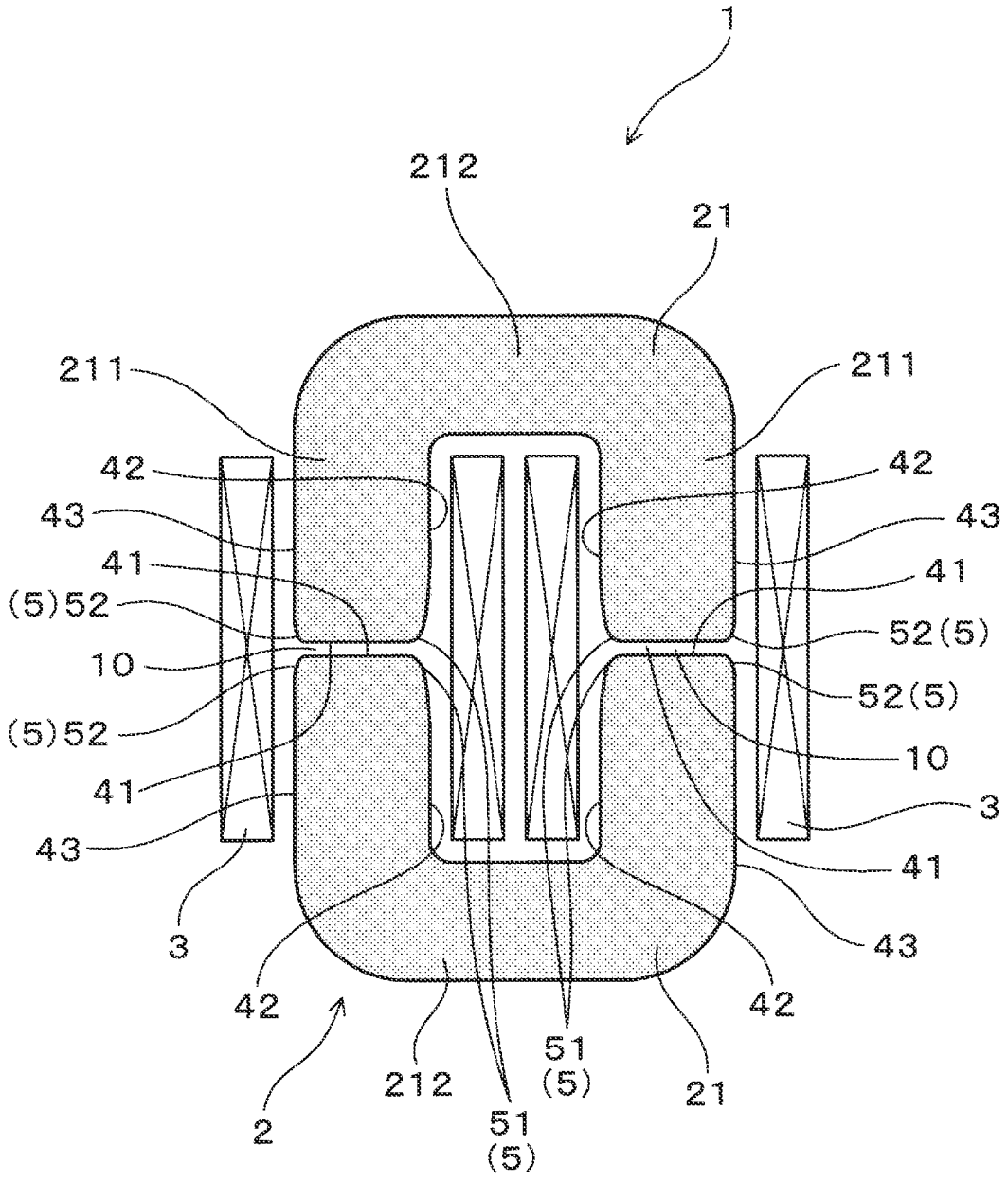
FIG. 1 is a cross-sectional view of a reactor according to a first embodiment.

Exemplary embodiments will be described hereinafter with reference to FIGS. 1-15. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

First Embodiment

FIG. 1 shows the overall configuration of a reactor 1 according to the first embodiment.

In the present embodiment, the reactor 1 is designed to be used as a component of an electric power conversion apparatus that is installed in, for example, an electric vehicle or a hybrid vehicle. More specifically, the reactor 1 is designed to be used as a component of a booster circuit of the electric power conversion apparatus; the booster circuit boosts the output voltage of an electric power supply to a predetermined voltage.

As shown in FIG. 1, the reactor 1 includes a laminated core 2 and a coil 3 wound around the laminated core 2.

Figure 2:
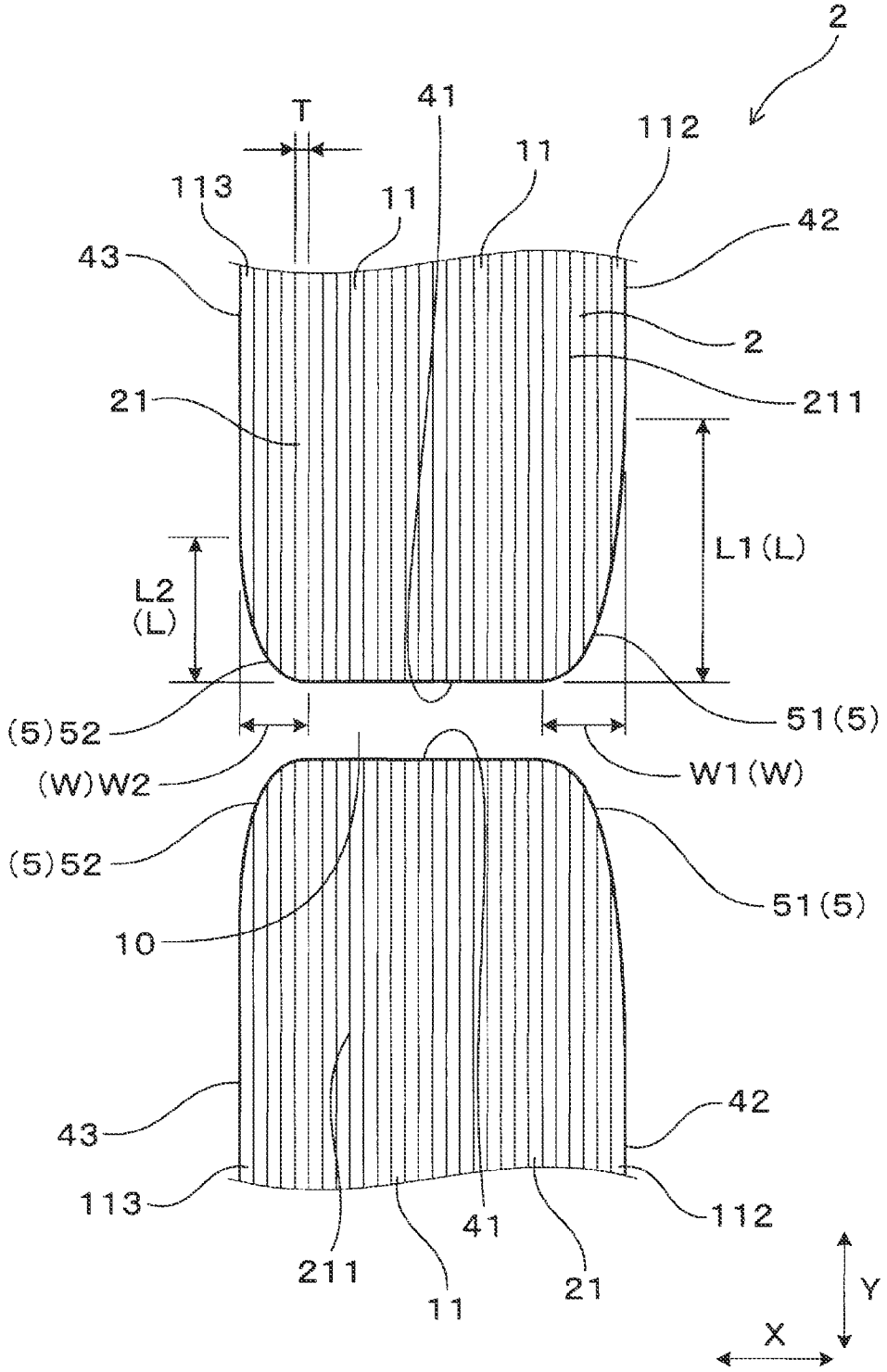
FIG. 2 is an enlarged top view of the vicinity of a gap in a laminated core of the reactor according to the first embodiment.
Figure 3:
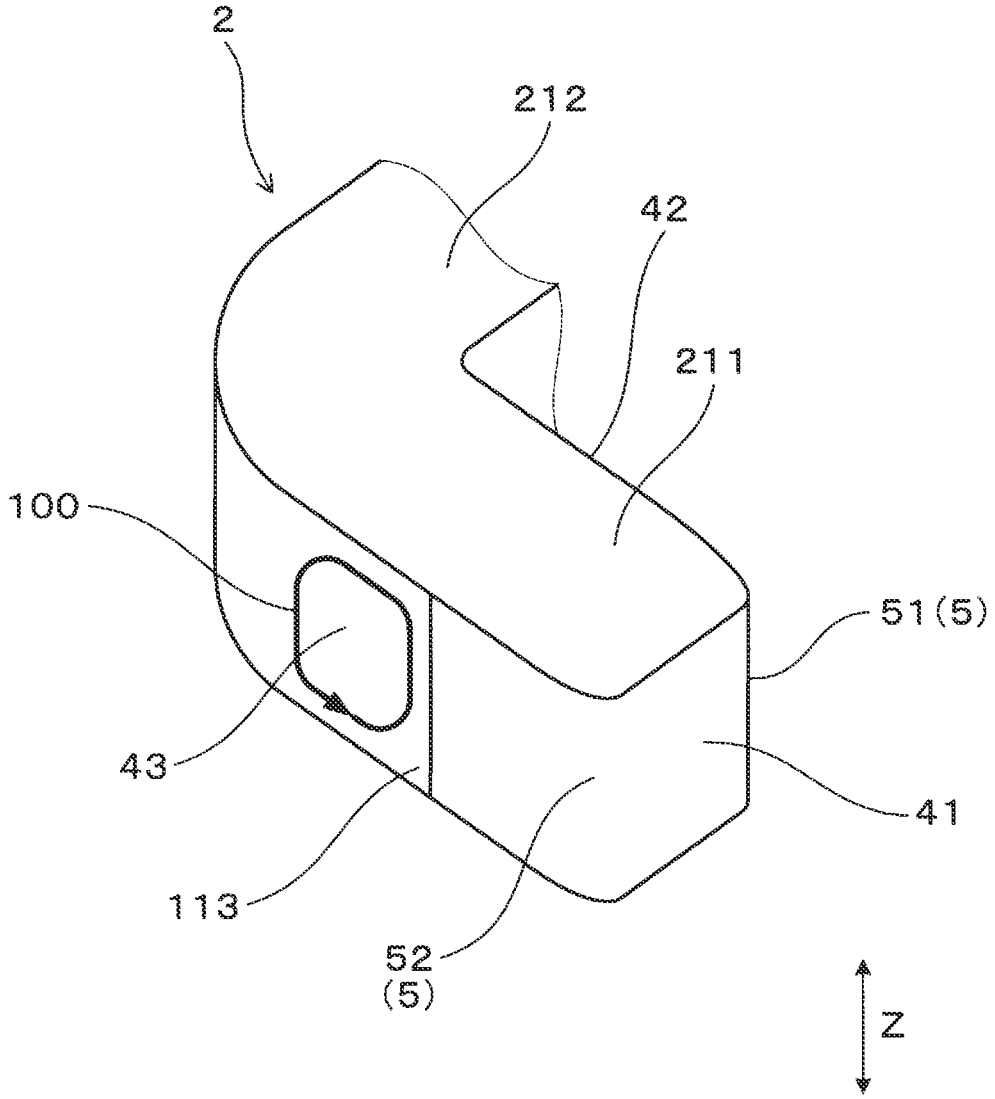
FIG. 3 is a perspective view of part of the laminated core.

Referring to FIGS. 2-3 together with FIG. 1, in the present embodiment, the laminated core 2 is formed by laminating a plurality of soft-magnetic ribbons 11 in a lamination direction X. The laminated core 2 has a pair of gaps 10 each of which is formed in the laminated core 2 across a magnetic path direction Y. Hereinafter, the "magnetic path direction Y" denotes the direction along which magnetic flux flows in the laminated core 2.

The laminated core 2 has, for each of the gaps 10, a pair of flat facing surfaces 41 that face the gap 10. Moreover, the laminated core 2 has, for each of the facing surfaces 41, a pair of flat inner and outer side surfaces 42 and 43 that are respectively on the inner and outer sides of the facing surface 41 in the lamination direction X of the laminated core 2. Further, between the facing surface 41 and the side surfaces 42 and 43, there are formed first corner curved surfaces 5.

As shown in FIG. 2, in the present embodiment, each of the first corner curved surfaces 5 has a width W in the lamination direction X which is set to be greater than the thickness T of each of the soft-magnetic ribbons 11. Moreover, for each of the first corner curved surfaces 5, the length L of the first corner curved surface 5 in the magnetic path direction L is set to be greater than the width W of the first corner curved surface 5 in the lamination direction X.

As shown in FIG. 1, in the present embodiment, the laminated core 2 is formed into a substantially annular shape such that the lamination direction X coincides with an inside-outside direction of the laminated core 2. Moreover, as shown in FIG. 2, among the first corner curved surfaces 5 of the laminated core 2, the inner corner curved surfaces 51 that are on the inner side of the facing surfaces 41 have a different shape from the outer corner curved surfaces 52 that are on the outer side of the facing surfaces 41.

More specifically, the length L1 of the inner corner curved surfaces 51 in the magnetic path direction Y is greater than the length L2 of the outer corner curved surfaces 52 in the magnetic path direction Y. Moreover, the width W1 of the inner corner curved surfaces 51 in the lamination direction X is also greater than the width W2 of the outer corner curved surfaces 52 in the lamination direction X.

As shown in FIG. 1, in the present embodiment, the laminated core 2 is comprised of a pair of laminated core segments 21 each of which is formed by laminating a predetermined number of the soft-magnetic ribbons 11.

More specifically, each of the laminated core segments 21 is substantially U-shaped to have a pair of leg portions 211 extending parallel to each other and a connecting portion 212 that connects ends of the leg portions 211 on the same side. The laminated core segments 21 are arranged so that the leg portions 211 of one of the laminated core segments 21 respectively face the leg portions 211 of the other laminated core segment 21 through the gaps 10 formed therebetween. Consequently, the distal end surfaces of the leg portions 211 of the laminated core segments 21 constitute the facing surfaces 41 of the laminated core 2 which face the gaps 10.

Moreover, as shown in FIGS. 1 and 3, the inner surfaces of the leg portions 211 of the laminated core segments 21 constitute the inner side surfaces 42 of the laminated core 2. The outer surfaces of the leg portions 211 of the laminated core segments 21 constitute the outer side surfaces 43 of the laminated core 2. The inner and outer side surfaces 42 and 43 of the laminated core 2 extend perpendicular to the facing surfaces 41 of the laminated core 2.

Furthermore, as shown in FIGS. 1-3, each of the first corner curved surfaces 5 of the laminated core 2 is formed so as to smoothly connect a corresponding pair of the facing surfaces 41 and the side surfaces 42 and 43 of the laminated core 2. In addition, each of the first corner curved surfaces 5 is formed over a plural number of the soft-magnetic ribbons 11.

As described previously, in the present embodiment, for each of the first corner curved surfaces 5, the length L of the first corner curved surface 5 in the magnetic path direction L is set to be greater than the width W of the first corner curved surface 5 in the lamination direction X. Consequently, as shown in FIG. 2, when viewed along a height direction Z that is perpendicular to both the magnetic path direction Y and the lamination direction X, each of the first corner curved surfaces 5 has a shape that is not a simple arc, but a curve whose curvature is gradually changed, such as an exponential curve.

Moreover, as shown in FIG. 3, each of the first corner curved surfaces 5 is formed over the entire range of the laminated core 2 in the height direction Z. In addition, each of the first corner curved surfaces 5 is formed by grinding.

More specifically, in the present embodiment, after forming the laminated core segments 21 by laminating the soft-magnetic ribbons 11, a grinding process (or cutting process) is performed on predetermined corner portions of the laminated core segments 21, thereby forming the first corner curved surfaces 5.

Moreover, as shown in FIG. 2, among the soft-magnetic ribbons 11 forming the laminated core 2, those peripheral soft-magnetic ribbons 112 and 113 which constitute the side surfaces 42 and 43 of the laminated core 2 have their respective distal ends considerably recessed in the magnetic path direction Y from the corresponding facing surfaces 41 of the laminated core 2. In particular, the distal ends of the inner peripheral soft-magnetic ribbons 112 that constitute the inner side surfaces 42 of the laminated core 2 are recessed from the corresponding facing surfaces 41 of the laminated core 2 more than the distal ends of the outer peripheral soft-magnetic ribbons 113 that constitute the outer side surfaces 43 of the laminated core 2.

In addition, the soft-magnetic ribbons 11 forming the laminated core 2 may be made, for example, of FINEMET (a registered trade mark) which is a nanocrystalline soft-magnetic material produced by Hitachi Metals, Ltd. Moreover, the soft-magnetic ribbons 11 are laminated with insulating layers (not shown) interposed therebetween. The thickness T of the soft-magnetic ribbons 11 may be set to, for example, 18 μm. The thickness of the insulating layers may be set to, for example, 5 μm.

As shown in FIG. 1, the coil 3 is wound around the leg portions 211 of the laminated core segments 21.

According to the present embodiment, it is possible to achieve the following advantageous effects.

In the present embodiment, the reactor 1 includes the laminated core 2 and the coil 3 wound around the laminated core 2. The laminated core 2 is formed of the soft-magnetic ribbons 11 that are laminated in the lamination direction X. The laminated core 2 has the gaps 10 that are formed in the laminated core 2 across the magnetic path direction Y. The laminated core 2 also has, for each of the gaps 10, the pair of flat facing surfaces 41 that face the gap 10. Moreover, the laminated core 2 has, for each of the facing surfaces 41, the pair of flat side surfaces 42 and 43 that are respectively on opposite sides of the facing surface 41 in the lamination direction X. The laminated core 2 further has, for each of the facing surfaces 41, the pair of first corner curved surfaces 5 that are respectively formed between the facing surface 41 and the side surface 42 and between the facing surface 41 and the side surface 43. Each of the first corner curved surfaces 5 has its width W in the lamination direction X greater than the thickness T of each of the soft-magnetic ribbons 11 forming the laminated core 2. For each of the first corner curved surfaces 5, the length L of the first corner curved surface 5 in the magnetic path direction Y is greater than the width W of the first corner curved surface 5 in the lamination direction X.

With the above configuration, since the reactor 1 employs the laminated core 2 as its magnetic core, it is possible to lower the magnetic reluctance of the magnetic core, thereby reducing the loss of the magnetic core. Consequently, it is possible to easily realize a desired inductance of the magnetic core.

Figure 6:
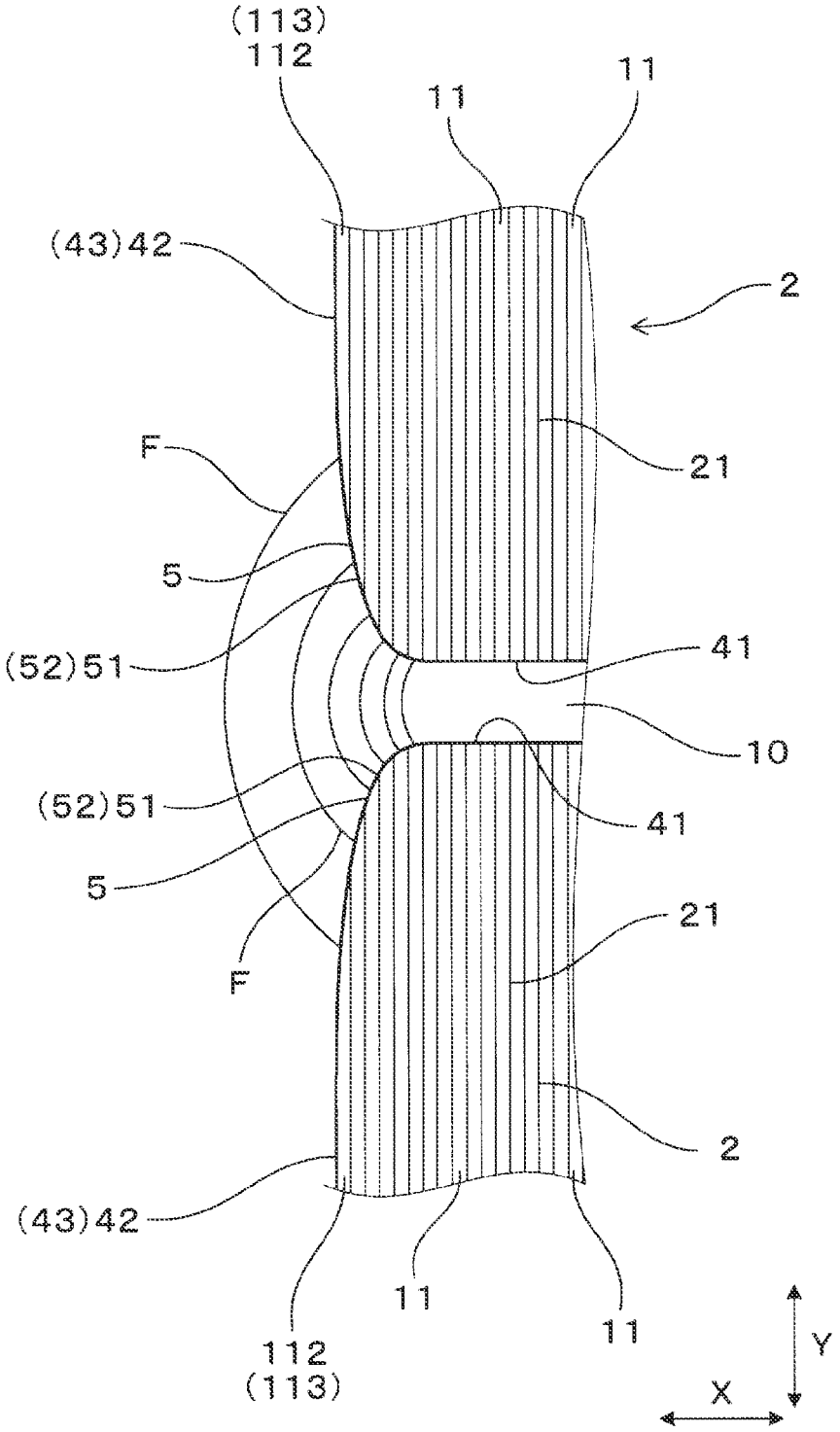
FIG. 6 is a schematic view illustrating no concentration of magnetic flux on particular soft-magnetic ribbons in the laminated core of the reactor according to the first embodiment.

Moreover, since each of the first corner curved surfaces 5 has its width W in the lamination direction X greater than the thickness T of each of the soft-magnetic ribbons 11, it is possible to prevent the start or end points of fringing flux F from concentrating on those peripheral soft-magnetic ribbons 112 and 113 which constitute the side surfaces 42 and 43 of the laminated core 2, as shown in FIG. 6. Consequently, it is possible to reduce eddy current 100 (shown in FIG. 3) generated on the side surfaces 42 and 43 of the laminated core 2, thereby reducing the eddy current loss. In addition, it is also possible to prevent magnetic flux from concentrating on particular soft-magnetic ribbons 11 in the laminated core 2, thereby reducing the hysteresis loss and the eddy current loss.

Figure 4:
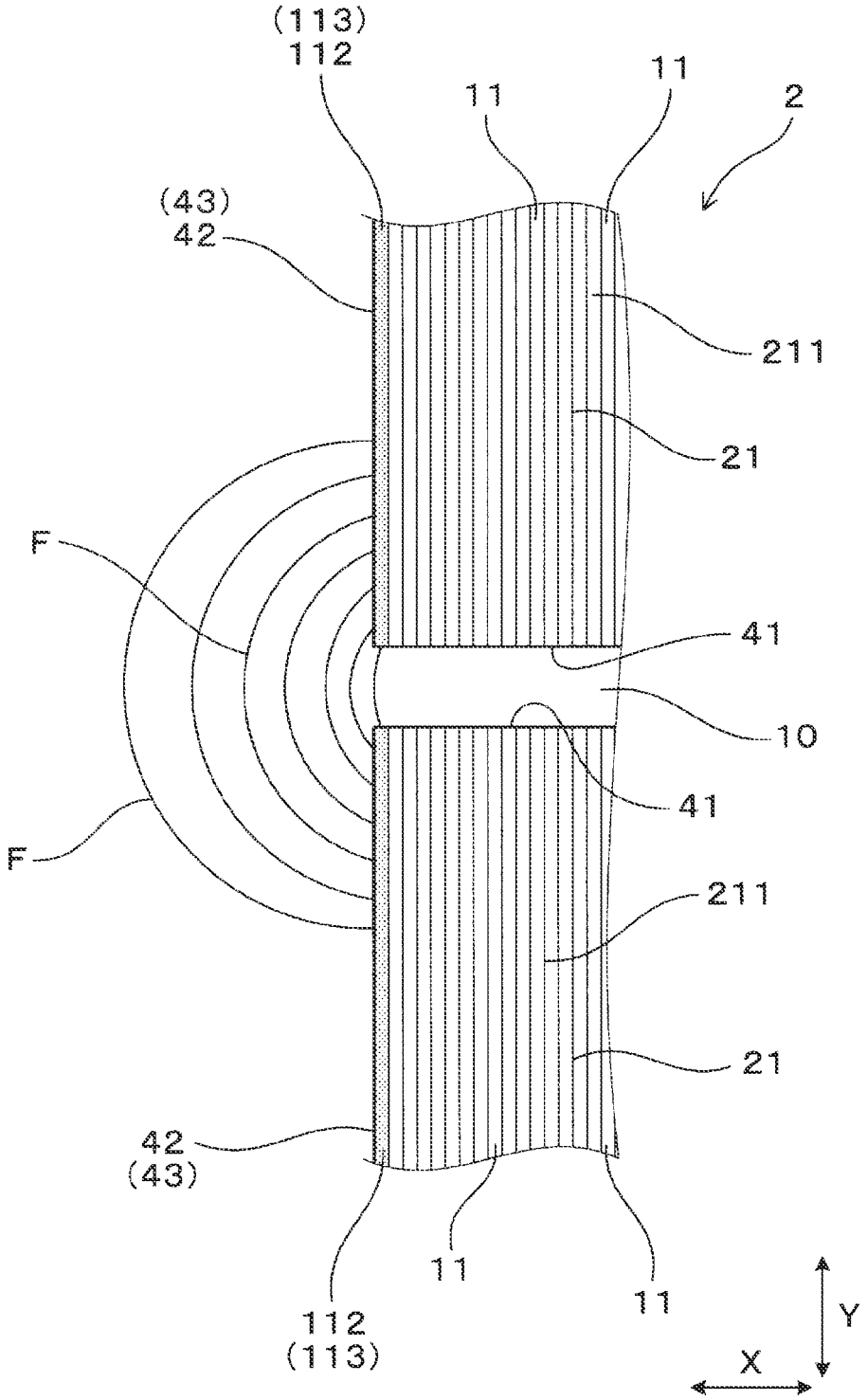
FIG. 4 is a schematic view illustrating the concentration of magnetic flux which would occur if no first corner curved surfaces were provided in the laminated core.
Figure 5:
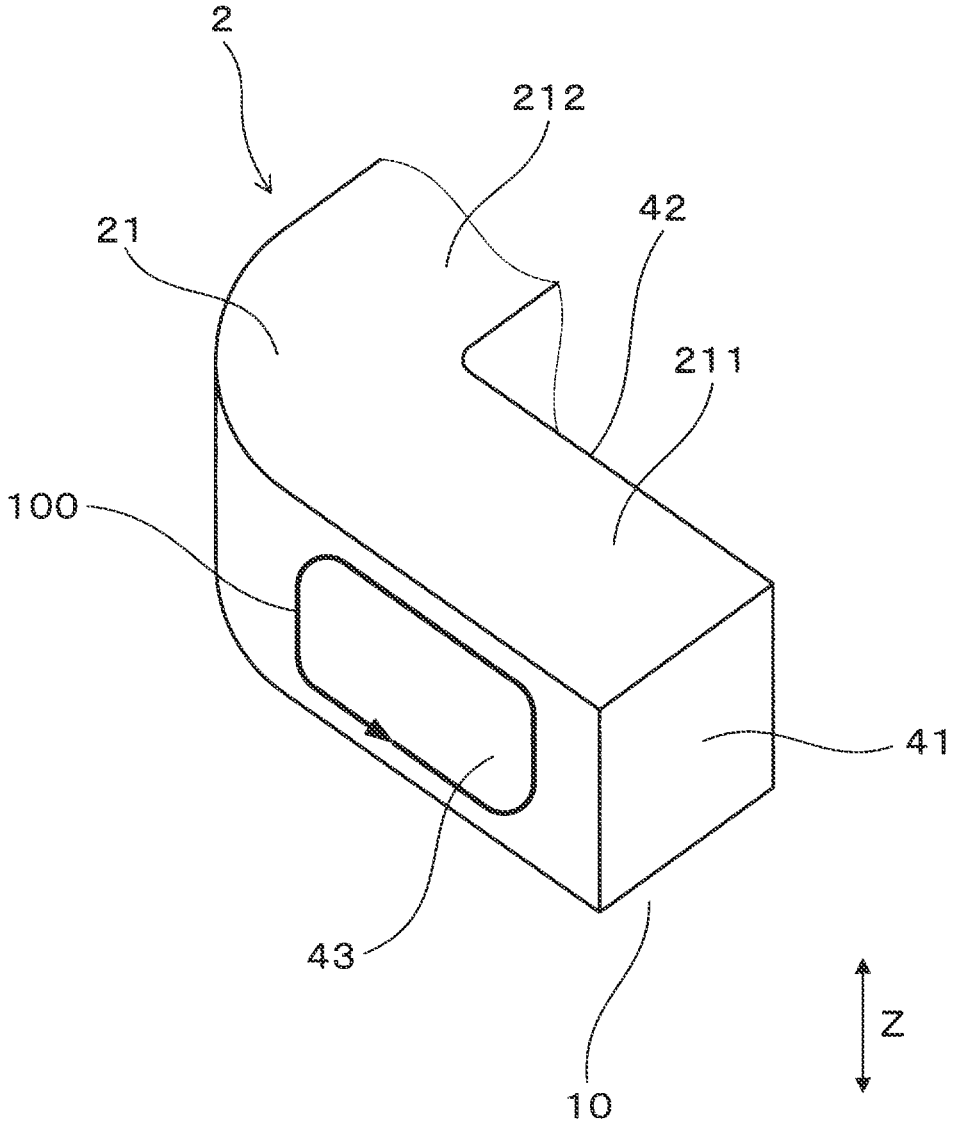
FIG. 5 is a schematic view illustrating a large eddy current which would be generated if no first corner curved surfaces were provided in the laminated core.

Specifically, as shown in FIG. 4, if no first corner curved surfaces 5 were provided in the laminated core 2, the start or end points of fringing flux F would be concentrated on those peripheral soft-magnetic ribbons 112 and 113 which constitute the side surfaces 42 and 43 of the laminated core 2. Therefore, magnetic flux would be concentrated on some particular soft-magnetic ribbons 11 (i.e., the peripheral soft-magnetic ribbons 112 and 113) in the laminated core 2, thereby increasing the hysteresis loss and the eddy current loss. Moreover, fringing flux F would enter the peripheral soft-magnetic ribbons 112 and 113 in the vicinities of the gaps 10 so as to intersect the side surfaces 42 and 43 of the laminated core 2. Consequently, as shown in FIG. 5, a large eddy current would be generated on the side surfaces 42 and 43 of the laminated core 2.

In contrast, in the present embodiment, as shown in FIG. 6, with the first corner curved surfaces 5 provided in the laminated core 2, it is possible to prevent magnetic flux from concentrating on some particular soft-magnetic ribbons 11 (i.e., the peripheral soft-magnetic ribbons 112 and 113) in the laminated core 2. Moreover, without concentration of fringing flux F that intersects the peripheral soft-magnetic ribbons 112 and 113 in the vicinities of the gaps 10, it is possible to prevent a large eddy current 100 from being generated on the side surfaces 42 and 43 of the laminated core 2. More specifically, as shown in FIG. 3, though eddy current 100 is generated on the side surfaces 42 and 43 of the laminated core 2, the eddy current 100 is small and far away from the gaps 10 (or from the facing surfaces 41).

Moreover, since the first corner curved surfaces 5 are not simple taper surfaces, it is possible to more effectively prevent magnetic flux from concentrating on particular soft-magnetic ribbons 11 in the laminated core 2.

Figure 7:
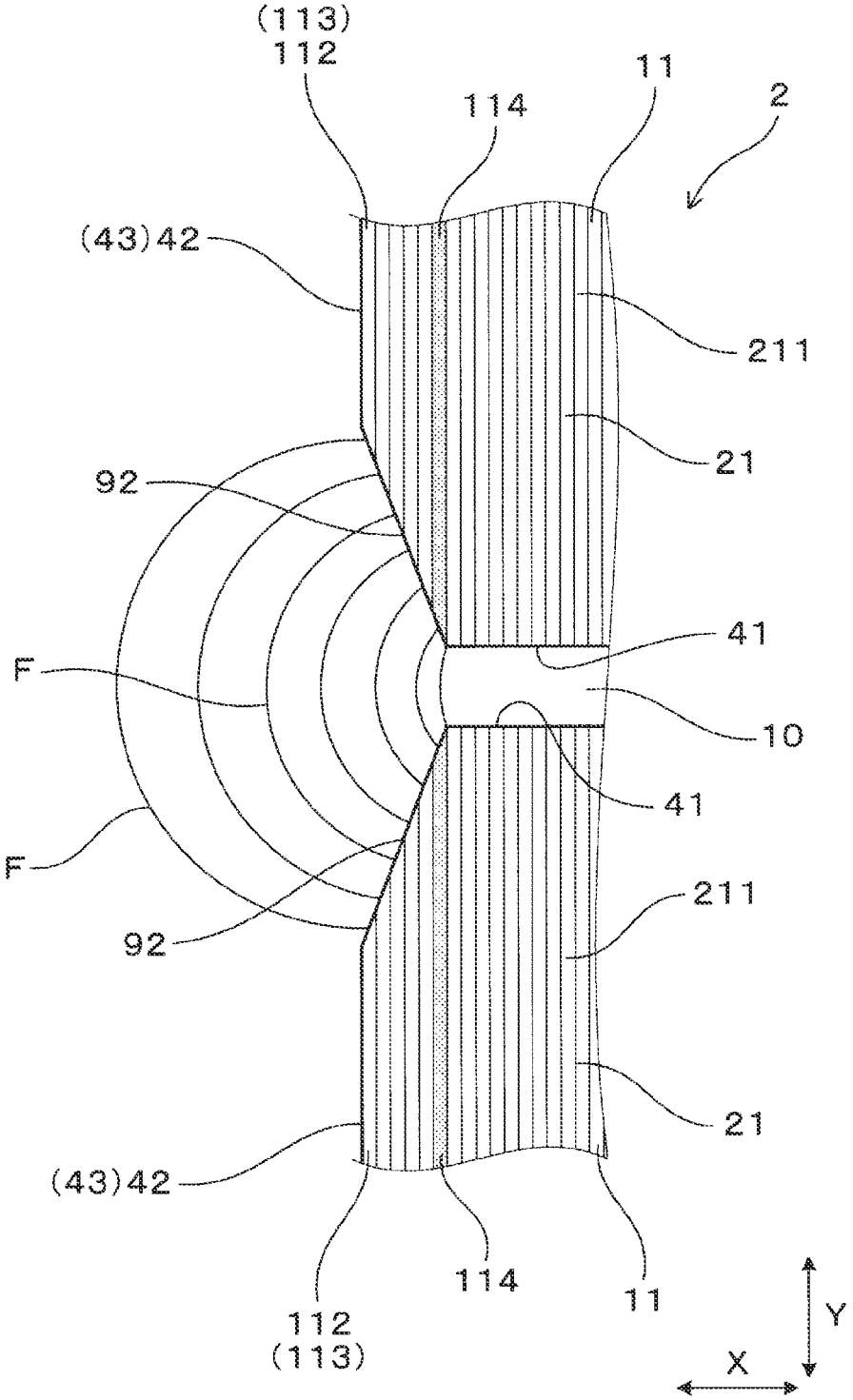
FIG. 7 is a schematic view illustrating the concentration of magnetic flux which would occur if planar taper surfaces were provided, instead of first corner curved surfaces, in the laminated core.

Specifically, as shown in FIG. 7, if planar taper surfaces 92 were provided, instead of the first corner curved surfaces 5, at corners of the laminated core 2, the following problems would occur. That is, in this case, it might be possible to suppress concentration of the start or end points of fringing flux F on those peripheral soft-magnetic ribbons 112 and 113 which constitute the side surfaces 42 and 43 of the laminated core 2. However, the start or end points of fringing flux F would be concentrated on those areas of the planar taper surfaces 92 which are closest to the corresponding facing surfaces 41 of the laminated core 2. Consequently, among the soft-magnetic ribbons 11 whose distal ends together constitute the planar taper surfaces 92, magnetic flux would be concentrated on those soft-magnetic ribbons 114 which are located closest to the corresponding facing surfaces 41 of the laminated core 2, thereby increasing the hysteresis loss and the eddy current loss.

In contrast, in the present embodiment, by providing the first corner curved surfaces 5, which are not simple taper surfaces, at corners of the laminated core 2, it is possible to prevent occurrence of the above problems. That is, as shown in FIG. 6, it is possible to prevent the start or end points of fringing flux F from concentrating on particular soft-magnetic ribbons 11.

Furthermore, since each of the first corner curved surfaces 5 has its length L in the magnetic path direction Y set to be greater than its width W in the lamination direction X, it is possible to enhance the effect of reducing the eddy current loss. More specifically, as shown in FIG. 3, it is possible to increase the distances from those peripheral soft-magnetic ribbons 112 and 113 which constitute the side surfaces 42 and 43 of the laminated core 2 to the corresponding facing surfaces 41 of the laminated core 2, thereby enhancing the effect of reducing the eddy current loss.

Moreover, in the present embodiment, the laminated core 2 has the substantially annular shape such that the lamination direction X coincides with an inside-outside direction of the laminated core 2. The first corner curved surfaces 5 include the inner corner curved surfaces 51 that are on the inner side of the facing surfaces 41 and the outer corner curved surfaces 52 that are on the outer side of the facing surfaces 41. The inner corner curved surfaces 51 have a different shape from the outer corner curved surfaces 52. The length L1 of the inner corner curved surfaces 51 in the magnetic path direction Y is greater than the length L2 of the outer corner curved surfaces 52 in the magnetic path direction Y.

With the above configuration, it is possible to set the gaps 10 to be wider on the inner peripheral side than on the outer peripheral side of the laminated core 2. Consequently, it is possible to set the magnetic reluctance of the laminated core 2 to be higher on the inner peripheral side than on the outer peripheral side. As a result, it is possible to effectively reduce fringing flux F generated on the inner peripheral side of the laminated core 2 where it is easy for magnetic flux to be concentrated.

To sum up, with the configuration of the reactor 1 according to the present embodiment, it is possible to reduce both the eddy current loss and the hysteresis loss.

Second Embodiment

Figure 8:
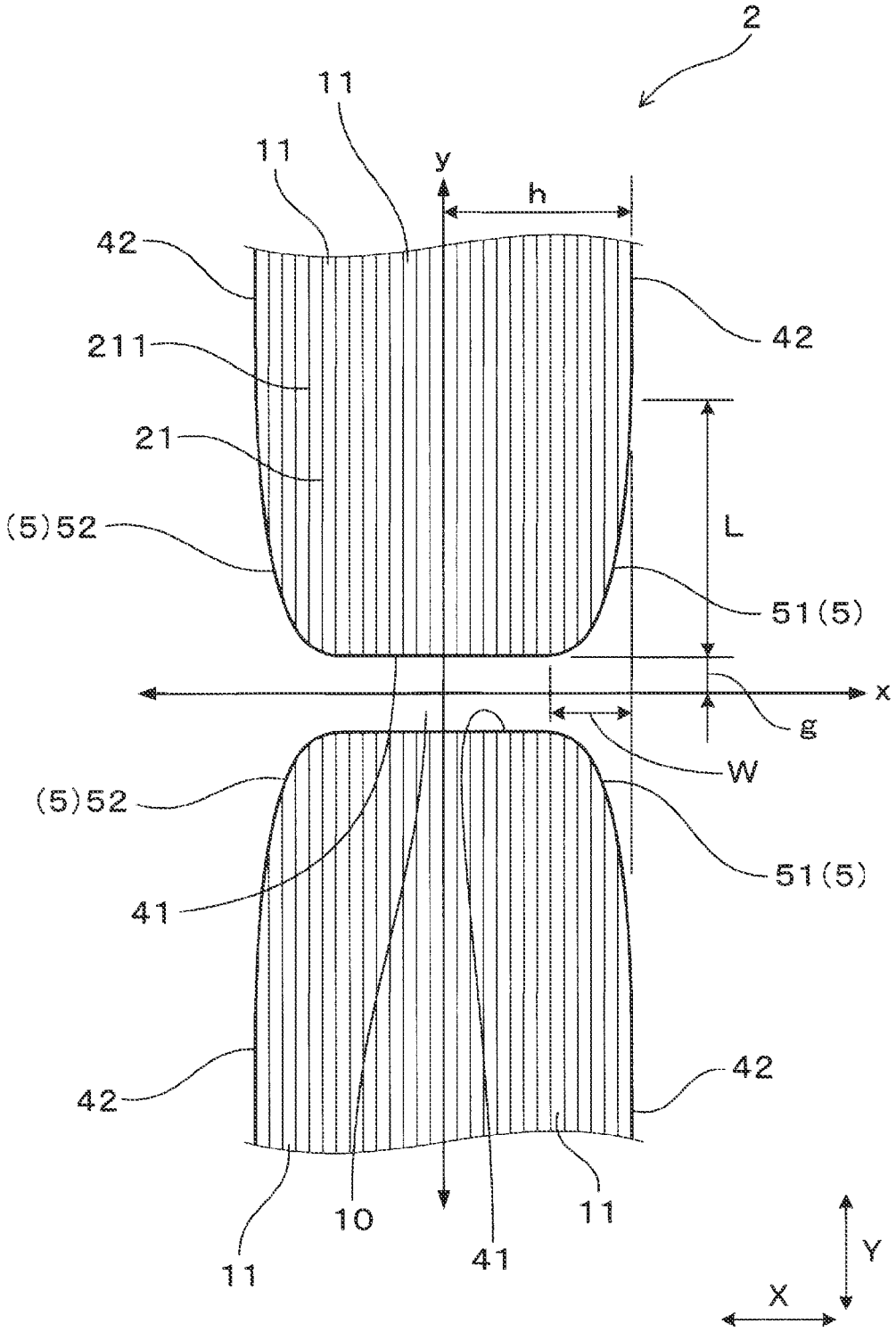
FIG. 8 is an enlarged top view of the vicinity of a gap in a laminated core of a reactor according to a second embodiment.

In this embodiment, as shown in FIG. 8, when viewed along the height direction Z perpendicular to both the lamination direction X and the magnetic path direction Y, each of the first corner curved surfaces 5 has a shape that is determined by the following Equation (1) on an x-y coordinate plane.

In addition, for each of the gaps 10, the x-axis of the x-y coordinate plane is set to a line that extends in the lamination direction X through the center of the gap 10. The y-axis of the x-y coordinate plane is set to a line that extends in the magnetic path direction Y and is equidistant from the inner and outer side surfaces 42 and 43 of the laminated core 2.

$$y = gab^{\frac{x+W-h}{g}} + g(1-a) \tag{1}$$

where g is half of the size of the gap 10, h is half of the distance between a pair of the inner and outer side surfaces 42 and 43 of the laminated core 2, W is the width of the first corner curved surface 5 in the lamination direction X, a is a positive constant, b is a positive constant greater than 1, and $(h-W) \le x \le h$.

In addition, attention is here focused on the shape of the first corner curved surface 5 on the first quadrant (i.e., the upper-right part) of the x-y coordinate plane where $x \ge 0$ and $y \ge 0$. However, it should be noted that though the signs of x and y coordinates on the other quadrants of the x-y coordinate plane are different from those on the first quadrant, the shapes of the first corner curved surfaces 5 on the other quadrants can also be determined using the above Equation (1).

Moreover, in the present embodiment, for each of the first corner curved surfaces 5, the length L of the first corner curved surface 5 in the magnetic path direction Y and the width W of the first corner curved surface 5 in the lamination direction X also satisfy the relationship of $W<L$ as in the first embodiment. In addition, in the present embodiment, the following relationships are further satisfied:

$5\,g \le L \le 50\,g$;

$L/10 \le W < L$;

$2\,g \le W < h$; and $2 \le b \le 12$.

Furthermore, in the present embodiment, the width W in the lamination direction X and the length L in the magnetic path direction Y are set to be the same for the inner corner curved surfaces 51 and the outer corner curved surfaces 52. However, it should be noted that at least one of the width W and the length L may be set to be different for the inner corner curved surfaces 51 and the outer corner curved surfaces 52 as in the first embodiment.

The performance of a reactor 1 according to the present embodiment has been confirmed by an experimental investigation.

More specifically, in the investigation, sample reactors 1-5 were prepared which had the shapes of the first corner curved surfaces 5 determined by the above Equation (1) using the parameters and constants given in the following TABLE 1. In addition, for the purpose of comparison, both a reference sample reactor and a comparative sample reactor were also prepared.

The reference sample reactor had the same basic shape of the laminated core 2 as the reactor 1 according to the first embodiment, but no gaps formed in the laminated core 2.

The comparative sample reactor had, instead of the first corner curved surfaces 5, planar taper surfaces provided at corners of the laminated core 2 so as to make an angle of 45° with respect to both the lamination direction X and the magnetic path direction Y. In addition, in the comparative sample reactor, both the width W of the planar taper surfaces in the lamination direction X and the length L of the planar taper surfaces in the magnetic path direction Y were set to 1 mm; the size of the gaps 10 were set to 2 mm.

TABLE 1

| SAMPLE | g (mm) | W (mm) | h (mm) | L (mm) | a | b | IRON LOSS |
|---|---|---|---|---|---|---|---|
| 1 | 1 | 5 | 10 | 20.13 | 0.008 | 4.74 | 1.053 |
| 2 | 1 | 5 | 10 | 16.85 | 0.00413 | 5.21 | 1.059 |
| 3 | 1 | 5 | 10 | 31.70 | 0.008 | 5.21 | 1.052 |
| 4 | 1 | 5 | 10 | 50.89 | 0.013 | 5.21 | 1.075 |
| 5 | 1 | 5 | 10 | 50.84 | 0.008 | 5.74 | 1.073 |
| REFERENCE SAMPLE | 0 | — | 10 | — | — | — | 1 |
| COMPARATIVE SAMPLE | 1 | 1 | 10 | 1 | — | — | 1.405 |

In the investigation, for each of the sample reactors, a predetermined electric current was supplied to flow through the coil 3 of the sample reactor, and the iron loss of the sample reactor caused by the supply of the predetermined electric current was measured.

The measurement results are shown in TABLE 1, where the iron losses of the sample reactors are converted into relative values to the iron loss of the reference sample reactor.

As seen from TABLE 1, due to the gaps 10 formed in the sample reactors 1-5, the iron losses of the sample reactors 1-5 were slightly higher than the iron loss of the reference sample reactor. However, the iron losses of the sample reactors 1-5 were considerably lower than the iron loss of the comparative sample reactor.

Accordingly, from the results of the experimental investigation, it has been made clear that a reactor 1 according to the present embodiment has the capability to effectively reduce the iron loss.

Third Embodiment

Figure 9:
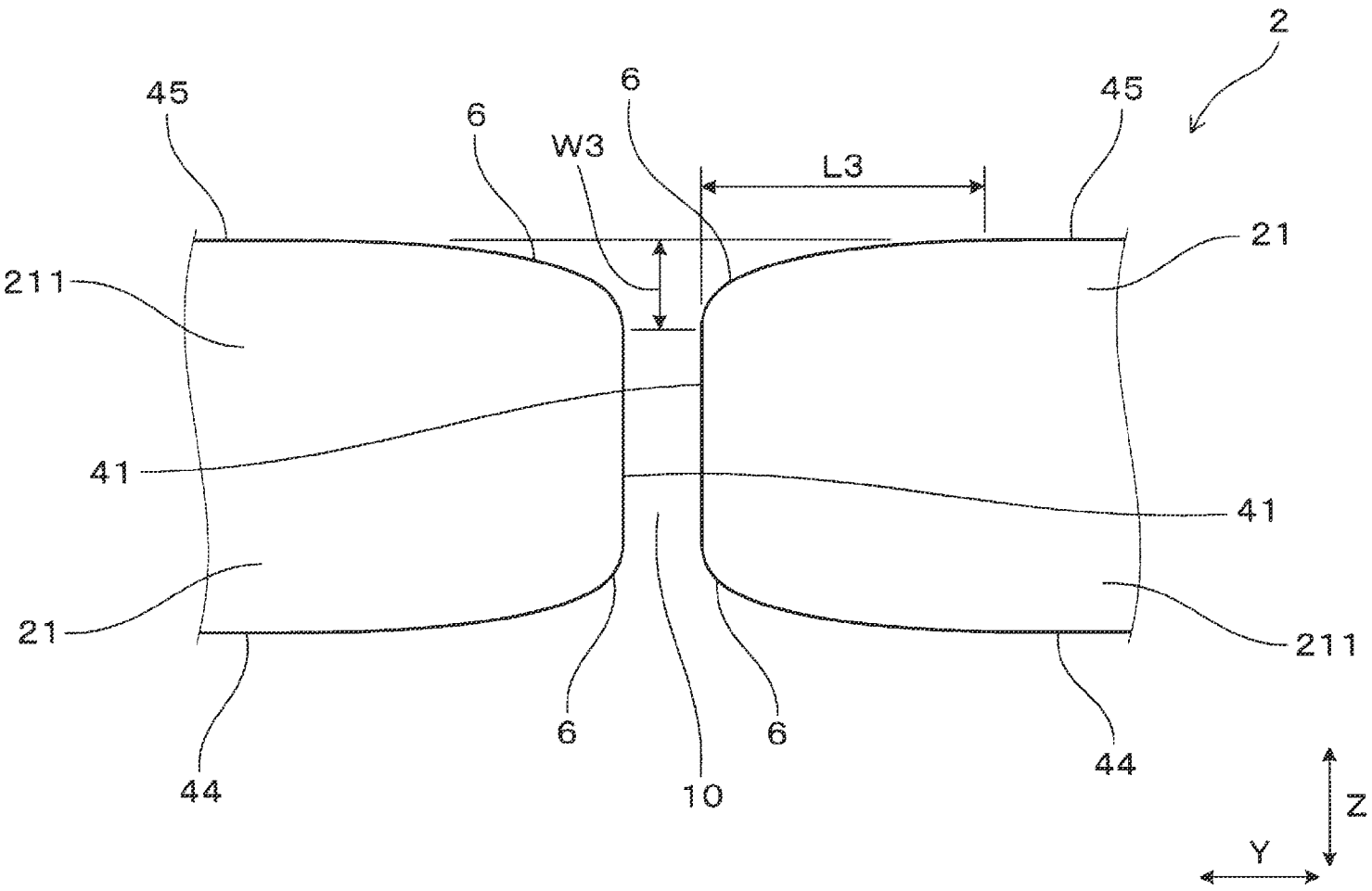
FIG. 9 is an enlarged side view of the vicinity of a gap in a laminated core of a reactor according to a third embodiment.

In this embodiment, as shown in FIG. 9, the laminated core 2 has, for each of the facing surfaces 41, a pair of flat end surfaces 44 and 45 that are respectively on opposite sides of the facing surface 41 in the height direction Z perpendicular to both the lamination direction X and the magnetic path direction Y. Moreover, the laminated core 2 further has a pair of second corner curved surfaces 6 that are respectively formed between the facing surface 41 and the end surface 44 and between the facing surface 41 and the end surface 45. Furthermore, for each of the second corner curved surfaces 6, the length L3 of the second corner curved surface 6 in the magnetic path direction Y is set to be greater than the width W3 of the second corner curved surface 6 in the height direction Z. Consequently, when viewed along the lamination direction X, each of the second corner curved surfaces 6 has a shape that is not a simple arc, but a curve whose curvature is gradually changed, such as an exponential curve.

In the present embodiment, the laminated core 2 also has the first corner curved surfaces 5 as in the first embodiment. More specifically, the laminated core 2 has, for each of the facing surfaces 41, the pair of first corner curved surfaces 5 (see FIG. 2) that are respectively formed between the facing surface 41 and the side surface 42 and between the facing surface 41 and the side surface 43 and the pair of second corner curved surfaces 6 (see FIG. 8) that are respectively formed between the facing surface 41 and the end surface 44 and between the facing surface 41 and the end surface 45.

Consequently, with the first corner curved surfaces 5 and the second corner curved surfaces 6, it is possible to more effectively prevent magnetic flux from concentrating on the corners of the facing surfaces 41.

Fourth Embodiment

Figure 10:
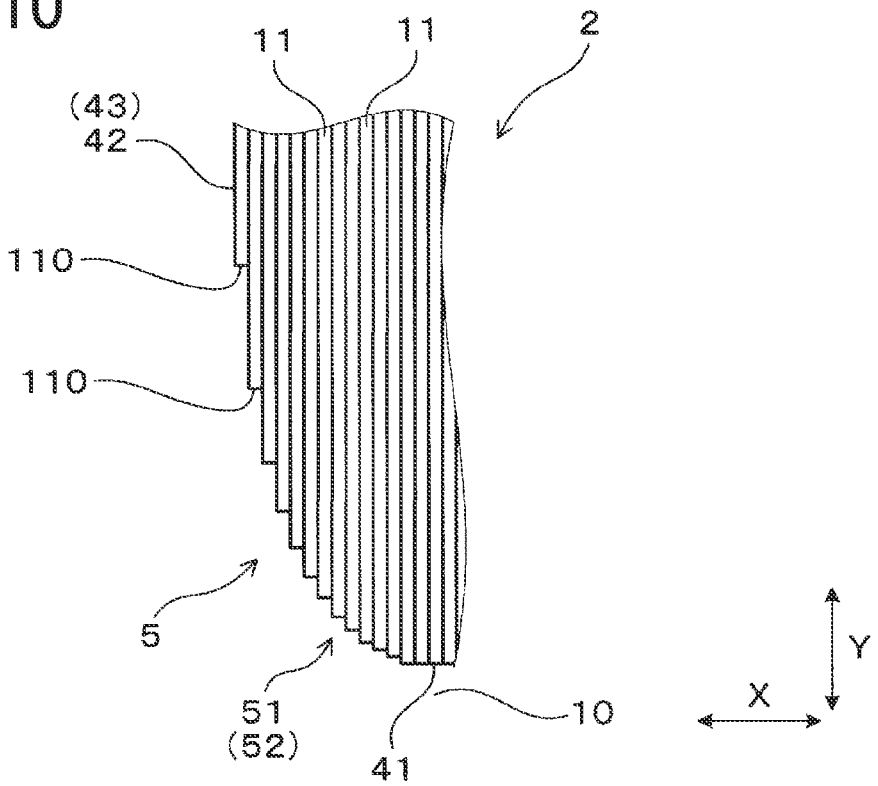
FIG. 10 is an enlarged top view of the vicinity of a first corner curved surface in a laminated core of a reactor according to a fourth embodiment.

In this embodiment, as shown in FIG. 10, for each of the first corner curved surfaces 5, those soft-magnetic ribbons 11 which together constitute the first corner curved surface 5 are laminated so that the distal ends 110 of those soft-magnetic ribbons 11 are offset from each other in the magnetic path direction Y. In other words, the positions of the distal ends 110 of those soft-magnetic ribbons 11 in the magnetic path direction Y are different from each other.

On the other hand, for each of the facing surfaces 41, those soft-magnetic ribbons 11 which together constitute the facing surface 41 are laminated so that the distal ends 110 of those soft-magnetic ribbons 11 are in alignment with each other in the lamination direction X. In other words, all the positions of the distal ends 110 of those soft-magnetic ribbons 11 in the magnetic path direction Y are the same.

Moreover, in the present embodiment, as shown in FIG. 10, for each of the first corner curved surfaces 5, those soft-magnetic ribbons 11 which together constitute the first corner curved surface 5 are laminated so that the closer the soft-magnetic ribbons 11 are to the facing surface 41 in the lamination direction X, the closer the distal ends 110 of the soft-magnetic ribbons 11 are to the facing surface 41 in the magnetic path direction Y. Further, the differences between the positions of the distal ends 110 of adjacent soft-magnetic ribbons 11 in the magnetic path direction Y are gradually decreased in the lamination direction X from the side surface 42 (or 43) to the facing surface 41. Consequently, when viewed along the height direction Z, the first corner curved surface 5 is represented by a curve that extends along the distal ends 110 of the soft-magnetic ribbons 11 to smoothly connect the side surface 42 (or 43) and the facing surface 41.

According to the present embodiment, it is possible to form the first corner curved surfaces 5 without performing a grinding (or cutting) process. Consequently, it is possible to reduce the number of steps required for manufacturing the reactor 1, thereby reducing the manufacturing cost and improving the productivity.

Fifth Embodiment

This embodiment is a modification of the fourth embodiment.

Specifically, in the fourth embodiment, for each of the first corner curved surfaces 5, those soft-magnetic ribbons 11 which together constitute the first corner curved surface 5 are laminated so that all the positions of the distal ends 110 of those soft-magnetic ribbons 11 in the magnetic path direction Y are different from each other (see FIG. 10).

Figure 11:
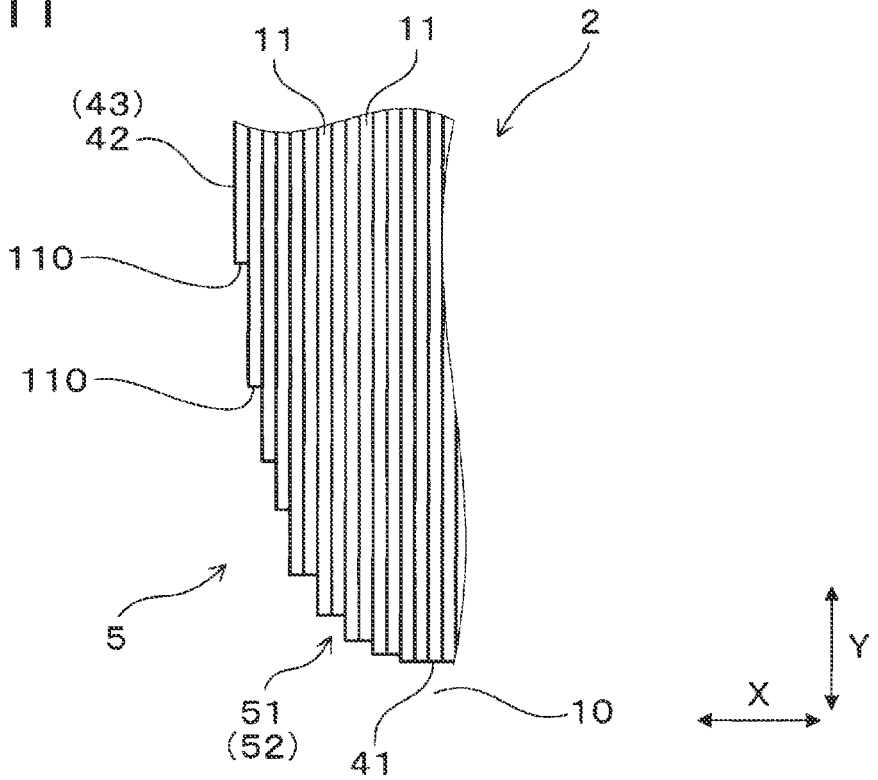
FIG. 11 is an enlarged top view of the vicinity of a first corner curved surface in a laminated core of a reactor according to a fifth embodiment.

In comparison, in the present embodiment, as shown in FIG. 11, for each of the first corner curved surfaces 5, those soft-magnetic ribbons 11 which together constitute the first corner curved surface 5 are laminated so that the positions of the distal ends 110 are the same for some adjacent pairs of those soft-magnetic ribbons 11.

Sixth Embodiment

This embodiment is a modification of the first embodiment.

Specifically, in the first embodiment, the laminated core 2 is substantially annular-shaped. Moreover, the laminated core 2 is comprised of the pair of laminated core segments 21 each of which is substantially U-shaped (see FIG. 1).

Figure 12:
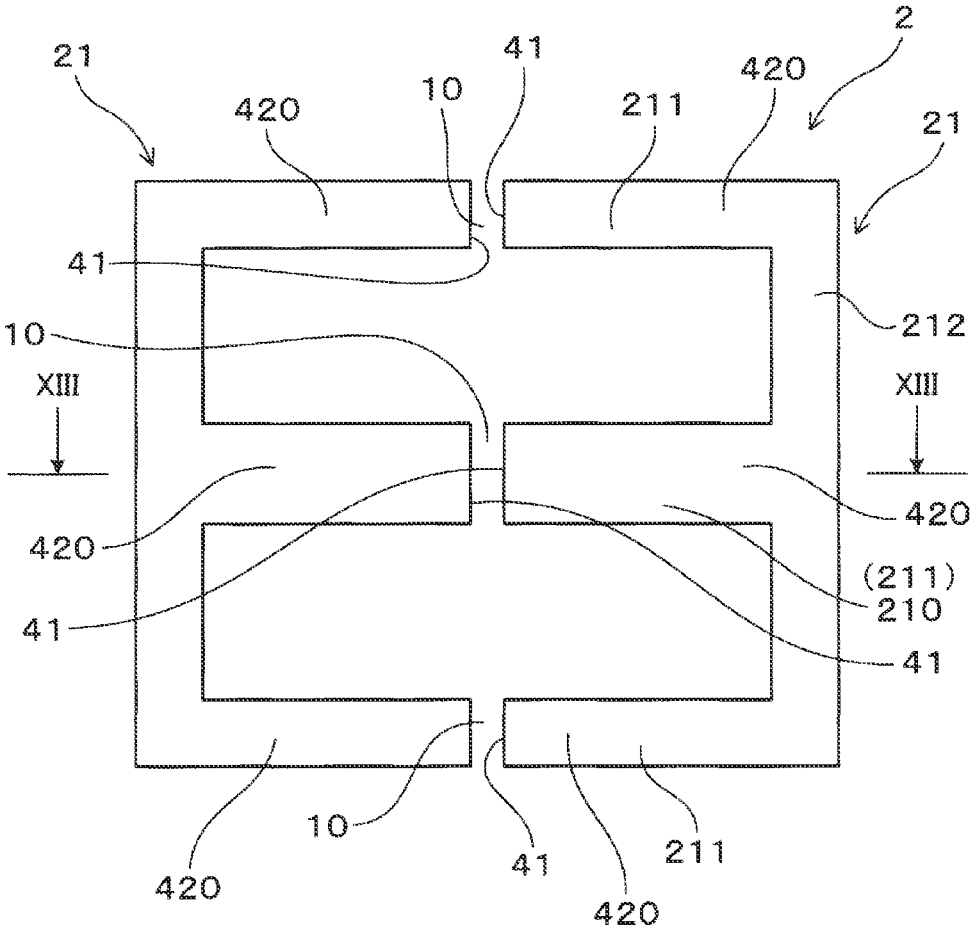
FIG. 12 is a top view of a laminated core of a reactor according to a sixth embodiment.
Figure 13:
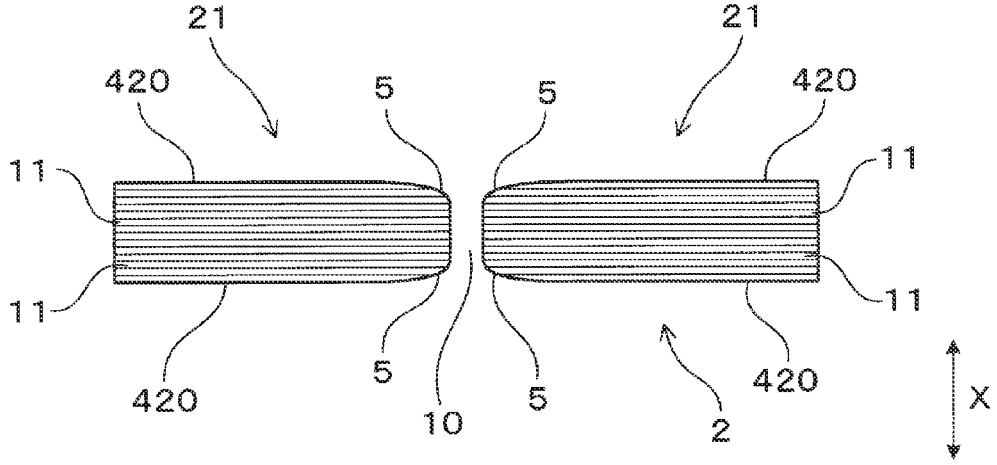
FIG. 13 is a cross-sectional view taken long the line XIII-XIII in FIG. 12.

In comparison, in the present embodiment, as shown in FIGS. 12-13, the laminated core 2 is configured as a so-called EE core. More specifically, the laminated core 2 is comprised of a pair of substantially E-shaped laminated core segments 21. Each of the laminated core segments 21 is formed by laminating a plurality of soft-magnetic ribbons 11 in the thickness direction thereof. That is, the lamination direction X coincides with the thickness direction of the soft-magnetic ribbons 11. In addition, each of the soft-magnetic ribbons 11 has a substantially E-shape when viewed along the thickness direction.

Moreover, in the present embodiment, as shown in FIG. 12, each of the substantially E-shaped laminated core segments 21 has three leg portions 211 extending parallel to each other and a connecting portion 212 that connects ends of the leg portions 211 on the same side. The laminated core segments 21 are arranged so that the leg portions 211 of one of the laminated core segments 21 respectively face the leg portions 211 of the other laminated core segment 21 through gaps 10 formed therebetween.

Each of the leg portions 211 of the laminated core segments 21 has a flat distal end surface that faces the corresponding gap 10; the distal end surface constitutes one facing surface 41 of the laminated core 2. Moreover, as shown in FIG. 13, each of the leg portions 211 of the laminated core segments 21 also has a pair of flat side surfaces that are respectively on opposite sides of the distal end surface (i.e., the facing surface 41) of the leg portion 211 in the lamination direction X; the pair of side surfaces constitutes one pair of side surfaces 420 of the laminated core 2.

Furthermore, in the present embodiment, as shown in FIGS. 12-13, the laminated core 2 has, for each of the facing surfaces 41, a pair of first corner curved surfaces 5 that are formed between the facing surface 41 and the pair of side surfaces 420 respectively on opposite sides of the facing surface 41 in the lamination direction X so as to smoothly connect the facing surface 41 and the pair of side surfaces 420. In addition, the first corner curved surfaces 5 have substantially the same shape.

Moreover, though not shown in the figures, the coil 3 is wound around, among all the leg portions 211 of the laminated core segments 21, the center leg portions 210 of the laminated core segments 21.

According to the present embodiment, it is also possible to achieve the same advantageous effects as described in the first embodiment.

Seventh Embodiment

This embodiment is another modification of the first embodiment.

Figure 14:
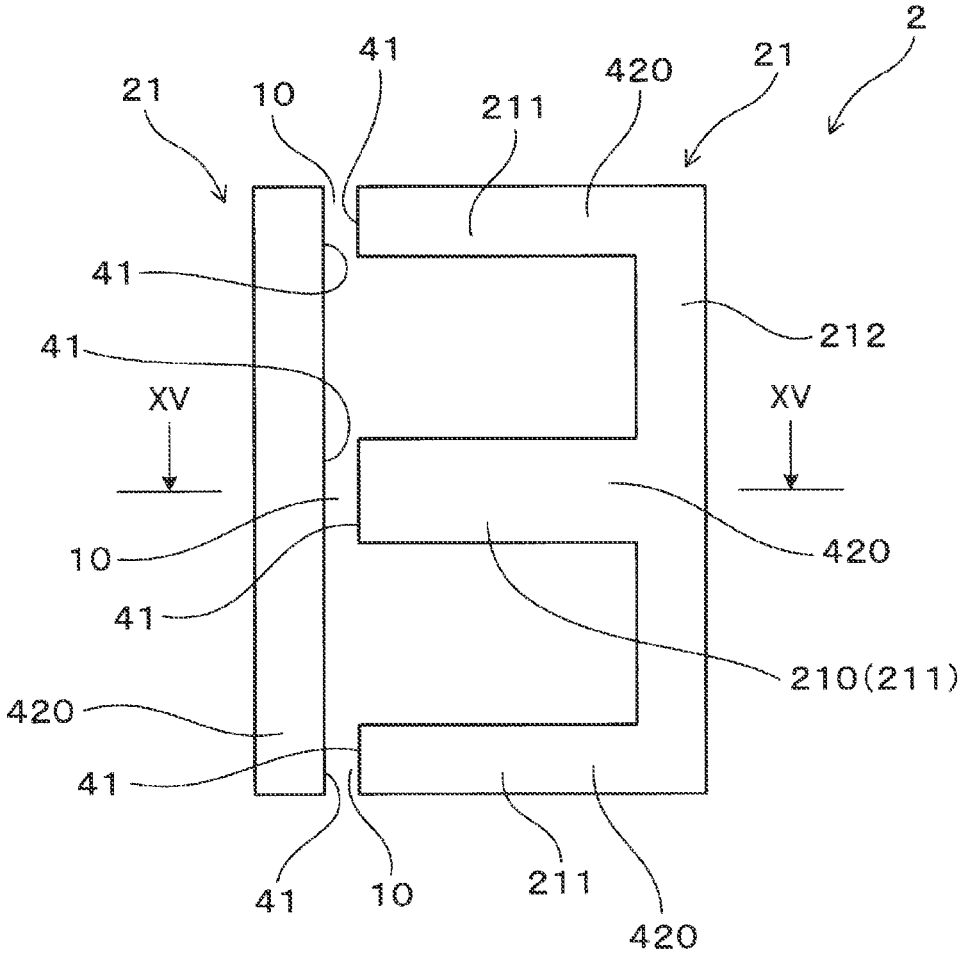
FIG. 14 is a top view of a laminated core of a reactor according to a seventh embodiment.
Figure 15:
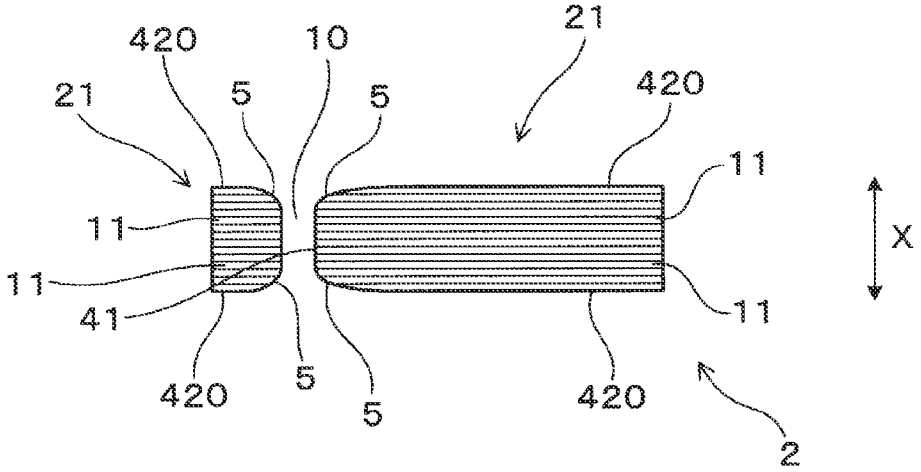
FIG. 15 is a cross-sectional view taken long the line XV-XV in FIG. 14.

In the present embodiment, as shown in FIGS. 14-15, the laminated core 2 is configured as a so-called EI core. More specifically, the laminated core 2 is comprised of a substantially E-shaped laminated core segment 21 and a substantially I-shaped (i.e., straight) laminated core segment 21.

The substantially E-shaped laminated core segment 21 has the same configuration as the laminated core segments 21 described in the sixth embodiment.

The substantially I-shaped laminated core segment 21 has a flat side surface arranged to face, in a direction perpendicular to both the lamination direction X and the longitudinal direction of the substantially I-shaped laminated core segment 21, the distal end surfaces (i.e., the facing surfaces 41) of the leg portions 211 of the substantially E-shaped laminated core segment 21 through gaps 10 formed therebetween. This side surface constitutes one facing surface 41 of the laminated core 2.

The substantially I-shaped laminated core segment 21 also has a pair of flat side surfaces that are respectively on opposite sides of the side surface (i.e., the facing surface) 41 in the lamination direction X. The pair of side surfaces constitutes one pair of side surfaces 420 of the laminated core 2.

Furthermore, in the present embodiment, as shown in FIGS. 14-15, the laminated core 2 has, for each of the facing surfaces 41, a pair of first corner curved surfaces 5 that are formed between the facing surface 41 and the pair of side surfaces 420 respectively on opposite sides of the facing surface 41 in the lamination direction X so as to smoothly connect the facing surface 41 and the pair of side surfaces 420. In addition, the first corner curved surfaces 5 have substantially the same shape.

Moreover, though not shown in the figures, the coil 3 is wound around, among the three leg portions 211 of the substantially E-shaped laminated core segment 21, the center leg portions 210 of the substantially E-shaped laminated core segment 21.

According to the present embodiment, it is also possible to achieve the same advantageous effects as described in the first embodiment.

While the above particular embodiments have been shown and described, it will be understood by those skilled in the art that various modifications, changes, and improvements may be made without departing from the spirit of the present invention.

For example, the second corner curved surfaces 6 provided in the laminated core 2 according to the third embodiment may also be provided in the laminated cores 2 according to the sixth and seventh embodiments.

What is claimed is:

1. A reactor comprising:

a laminated core formed of a plurality of soft-magnetic ribbons that are laminated in a lamination direction; and a coil wound around the laminated core, wherein the laminated core has a gap that is formed in the laminated core across a magnetic path direction along which magnetic flux flows in the laminated core, the laminated core also has a flat facing surface that faces the gap and a pair of flat side surfaces that are respectively on opposite sides of the facing surface in the lamination direction, the laminated core further has a pair of first corner curved surfaces that are respectively formed between the facing surface and one of the side surfaces and between the facing surface and the other side surface, each of the first corner curved surfaces has a width in the lamination direction greater than a thickness of each of the soft-magnetic ribbons forming the laminated core, for each of the first corner curved surfaces, a length of the first corner curved surface in the magnetic path direction is greater than the width of the first corner curved surface in the lamination direction, the laminated core has a substantially annular shape such that the lamination direction coincides with an inside-outside direction of the laminated core, the first corner curved surfaces comprise an inner first corner curved surface that is on the inner side of the facing surface and an outer first corner curved surface that is on the outer side of the facing surface, the inner first corner curved surface has a different shape from the outer first corner curved surface, and the length of the inner first corner curved surface in the magnetic path direction is greater than the length of the outer first corner curved surface in the magnetic path direction, when viewed along a height direction perpendicular to both the lamination direction and the magnetic path direction, each of the first corner curved surfaces has a shape that is determined by the following Equation (1) on an x-y coordinate plane:

$$y = gab^{\frac{x+W-h}{g}} + g(1-a) \tag{1}$$

where the x-y coordinate plane has its x-axis set to a line that extends in the lamination direction through a center of the gap and its y-axis set to a line that extends in the magnetic path direction and is equidistant from the side surfaces of the laminated core, g is half of the size of the gap, h is half of the distance between the side surfaces of the laminated core, W is the width of the first corner curved surface in the lamination direction, a is a positive constant, b is a positive constant greater than 1, and $(h-W)<x<h$.

2. The reactor as set forth in claim 1, wherein the laminated core also has a pair of flat end surfaces that are respectively on opposite sides of the facing surface in a height direction of the laminated core, the height direction being perpendicular to both the lamination direction and the magnetic path direction, the laminated core further has a pair of second corner curved surfaces that are respectively formed between the facing surface and one of the end surfaces and between the facing surface and the other end surface, and for each of the second corner curved surfaces, a length of the second corner curved surface in the magnetic path direction is greater than a width of the second corner curved surface in the height direction.

3. The reactor as set forth in claim 1, wherein for each of the first corner curved surfaces, those soft-magnetic ribbons which together constitute the first corner curved surface are laminated so that distal ends of those soft-magnetic ribbons are offset from one another in the magnetic path direction.

* * * * *